US008036588B2

(12) United States Patent
Ishida et al.

(10) Patent No.: US 8,036,588 B2
(45) Date of Patent: Oct. 11, 2011

(54) IMAGE FORMING APPARATUS

(75) Inventors: Yujiro Ishida, Hino (JP); Tetsu Sekine, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 830 days.

(21) Appl. No.: 12/015,012

(22) Filed: Jan. 16, 2008

(65) Prior Publication Data

US 2008/0232877 A1 Sep. 25, 2008

(30) Foreign Application Priority Data

Mar. 20, 2007 (JP) ..... 2007-071865

(51) Int. Cl.
*G03G 15/00* (2006.01)

(52) U.S. Cl. ..... 399/395; 271/228

(58) Field of Classification Search ..... 271/228; 400/579

See application file for complete search history.

(56) References Cited

U.S. PATENT DOCUMENTS

| | | | | |
|---|---|---|---|---|
| 6,115,579 | A * | 9/2000 | Taniguchi et al. | 399/411 |
| 7,574,167 | B2 * | 8/2009 | Okamoto et al. | 399/395 |
| 2005/0098939 | A1 * | 5/2005 | Lin | 271/109 |
| 2007/0052162 | A1 * | 3/2007 | Fujita et al. | 271/228 |

FOREIGN PATENT DOCUMENTS

| | | | |
|---|---|---|---|
| JP | 05201587 | A * | 8/1993 |
| JP | 06001499 | A * | 1/1994 |
| JP | 06016284 | A * | 1/1994 |
| JP | 6-263287 | | 9/1994 |
| JP | 08225196 | A * | 9/1996 |
| JP | 10-212055 | | 8/1998 |
| JP | 2003118890 | A * | 4/2003 |

* cited by examiner

*Primary Examiner* — Daniel J Colilla

*Assistant Examiner* — Allister Primo

(74) *Attorney, Agent, or Firm* — Finnegan, Henderson, Farabow, Garrett & Dunner, L.L.P.

(57) ABSTRACT

In an image forming apparatus including an image forming section which forms an image on a sheet and a conveyance section which conveys the sheet to the image forming section, the conveyance section includes: a registration roller, a plurality of loop forming rollers which cause the sheet to form a loop, provided upstream of the registration roller in a sheet conveyance direction and arranged in a direction perpendicular to the sheet conveyance direction, a skew detection sensor which detects a skew of the sheet, and a conveyance roller provided upstream of the loop forming roller; and a control section which controls independently each of the plurality of loop forming rollers based on the detected result of the skew detection sensor. The conveyance roller is swung in the direction perpendicular to the sheet conveyance direction.

6 Claims, 5 Drawing Sheets

IMAGE FORMING APPARATUS

This application is based on Japanese Patent Application No. 2007-071865 filed on Mar. 20, 2007, which is incorporated hereinto by reference.

BACKGROUND OF THE INVENTION

The present invention relates to an image forming apparatus for forming an image on a paper sheet.

In the image forming apparatus for forming an image on a paper sheet, in some cases a sheet is conveyed in a state where the sheet skews to a transfer position where an image is transferred to the sheet.

Ideally, the sheet is conveyed to the transfer position in a state in which the leading edge and the trailing edge of the sheet cross orthogonally the conveyance direction and the side edges are parallel to the conveyance direction, but the sheet is sometimes offset from this state and conveyed, and the leading edge reaches the transfer position in a state in which it is inclined with respect to the conveyance direction of the sheet. This phenomenon is called skewing or inclination, and improvements have been done in order to prevent this skewing.

The most widely used technique for preventing skewing is so-called "loop conveyance" using a registration roller.

"Loop conveyance" is a technique in which a sheet is conveyed by a loop forming roller, and the sheet is caused to abut the registration roller that has been stopped and conveyance of the sheet by the loop forming roller is continued and by forming a loop upstream of the registration roller, the leading edge of the sheet is caused to cross orthogonally the conveyance direction.

After the loop is formed upstream of the registration roller, conveyance starts and the sheet is conveyed to the conveyance position.

The skew is corrected by this type of loop conveyance, but there is some limit to the skew correction using the registration roller in that loop conveyance is not sufficient in the recent image forming apparatuses that require high accuracy at the image position on the sheet.

In Unexamined Japanese Patent Application Publication Nos. 06-263287 and 10-212055, it has been proposed that each of a plurality of conveyance members arranged in parallel so as to cross orthogonally the sheet conveyance direction, is controlled based on the results from the sheet skew detector.

In Unexamined Japanese Patent Application Publication Nos. 06-263287 and 10-212055, the skew is corrected for two conveyance members that are arranged so as to orthogonally cross the conveyance direction by performing control based on the detection results from the detector.

The techniques of Unexamined Japanese Patent Application Publication Nos. 06-263287 and 10-212055 are effective for sheet skew correction, but insufficient for high accuracy skew correction.

In recent times, use of electrophotographic type image forming apparatus has been expanding in the field of short-run printing.

Compared to conventional office applications, printing requires higher image position accuracy and more types of papers are printed and thus there is a tendency for skewing to occur.

For this reason, the conventional techniques in Unexamined Japanese Patent Application Publication No. 06-263287 have become insufficient for preventing skew.

As shown in FIG. 7, in order to evaluate the degree of skew, the proportion of the offset amount ΔY in the conveyance direction Y due to a skew of the angle PA of the sheet with respect to the length PX in the direction X which orthogonally crosses the conveyance direction Y of the sheet P, or in other words the skew ratio is $(\Delta Y/PX)\times 100\%$.

The prior art technology is effective for correcting an offset amount of about 1%, but keeping the permissible amount of offset required by recent image forming apparatuses to 0.2% or less is difficult.

SUMMARY OF THE INVENTION

The object of the present invention is to solve the problems of this type of prior art skew prevention technology by providing an image forming device which is capable of forming an image on a sheet with high positional accuracy, and also forming image with high positional accuracy on various types of paper.

The object of the present invention is achieved by the following aspect.

In an image forming apparatus which is provided with an image forming section for forming an image on a sheet, and a conveyance section for conveying the sheet to the image forming section, the conveyance section includes a registration roller; a plurality of loop forming rollers for causing the sheet to form a loop, that are arranged on the upstream side in the sheet conveyance direction with respect to the registration roller and in the direction perpendicular to the sheet conveyance direction; a skew detection section for detecting a skew of the conveyed sheet; and a conveyance roller that is provided on the upstream side of the plurality of loop forming rollers; and a control section independently controls the plurality of loop forming rollers based on the detection results of the skew detection sensor, wherein the conveyance roller is slid in the direction perpendicular to the sheet conveyance direction.

DETAILED DESCRIPTION OF THE PREFERRED EMBODIMENT

[Image Forming Apparatus]

Figure 1:
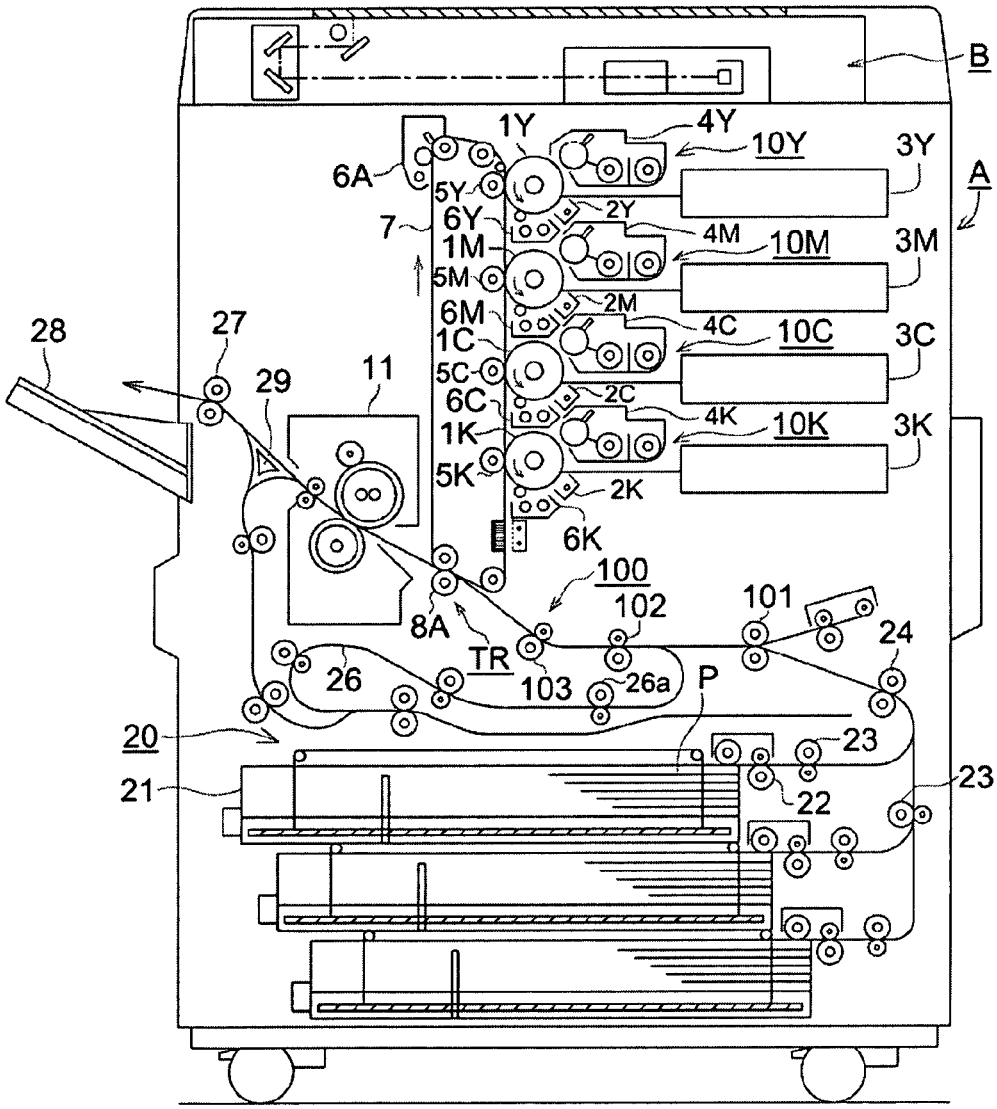
FIG. 1 shows the overall structure of image forming apparatus of an embodiment of the present invention.

FIG. 1 shows the overall structure of image forming apparatus of the first embodiment of the present invention.

The image forming apparatus shown is called the tandem type color image forming apparatus, and has a plurality of sets of image forming units 10Y, 10M, 10C and 10K; a belt-like intermediate transfer member 7; a conveyance section 100; a sheet storing section 20; re-feeding section 26 and a fixing unit 11. There is a reading device B on top of an image forming section A which is constituted of the image forming units 10Y, 10M, 10C and 10K and the belt-like intermediate transfer member 7.

The image forming unit 10Y for forming yellow toner images has a drum-like photoreceptor 1Y; a charging section 2Y that is disposed at the periphery of the photoreceptor 1Y; an imagewise exposure section 3Y; a developing section 4Y; a primary transfer roller 5Y and a cleaning section 6Y. In addition, the image forming unit 10M for forming magenta toner images has a drum-like photoreceptor 1M; a charging section 2M that is disposed at the periphery of the photoreceptor 1M; an imagewise exposure section 3M; a developing section 4M; a primary transfer roller 5M and a cleaning section 6M. The image forming unit 10C for forming cyan toner images has a drum-like photoreceptor 1C; a charging section 2C that is disposed at the periphery of the photoreceptor 1C; an imagewise exposure section 3C; a developing section 4C; a primary transfer roller 5C and a cleaning section 6C. The image forming unit 10K for forming black toner images has a drum-like receptor 1K; a charging section 2K that is disposed at the periphery of the photoreceptor 1K; an imagewise exposure section 3K; a developing section 4K; a primary transfer roller 5K and a cleaning section 6K.

The toner images of each of the colors formed at the image forming units 10Y, 10M, 10C, 10K are successively subjected to primary transfer onto the intermediate transfer member 7 by the primary transfer rollers 5Y, 5M, 5C and 5K and to form a superimposed color toner image.

Sheet P is stored in the sheet cassette 21 of the sheet storage section 20 and one sheet at a time is fed by the sheet feed unit, and the conveyance rollers 23 and 24 convey the sheet to the transfer position TR formed by the secondary transfer roller 8A via the conveyance section 100.

At the transfer position TR, the color toner images are all secondarily transferred to the sheet P. The sheet P on which the color toner image has been transferred is subjected to fixing processing by the fixing device 11 and then nipped by the ejection tray 27 and placed on the ejection tray 28 which is outside the device.

Meanwhile, the intermediate transfer member in which the color toner image has been transferred to the sheet P by the secondary transfer roller 8A is cleaned by the cleaning section 6A and the toner remaining on the surface of the intermediate transfer member 7 is removed.

The primary transfer roller 5K is normally in pressure contact with the photoreceptor 1K during image formation. The other primary transfer rollers 5Y, 5M, and 5C are in pressure contact with the respective corresponding photoreceptor 1Y, 1M and 1C only at the time of color image formation.

The secondary transfer roller 8A is only in pressure contact with the intermediate transfer body 7 when the sheet P passes the transfer position TR and is subjected to secondary transfer.

Numeral 26 is a re-feeding section for rear surface image formation.

Figure 2:
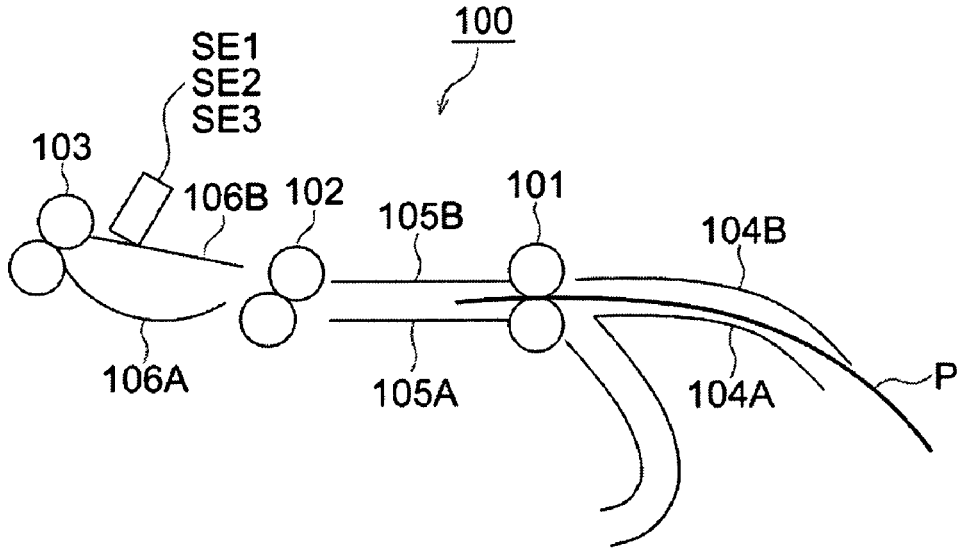
FIG. 2 is a side view of the conveyance section of image forming apparatus of an embodiment of the present invention.
Figure 3:
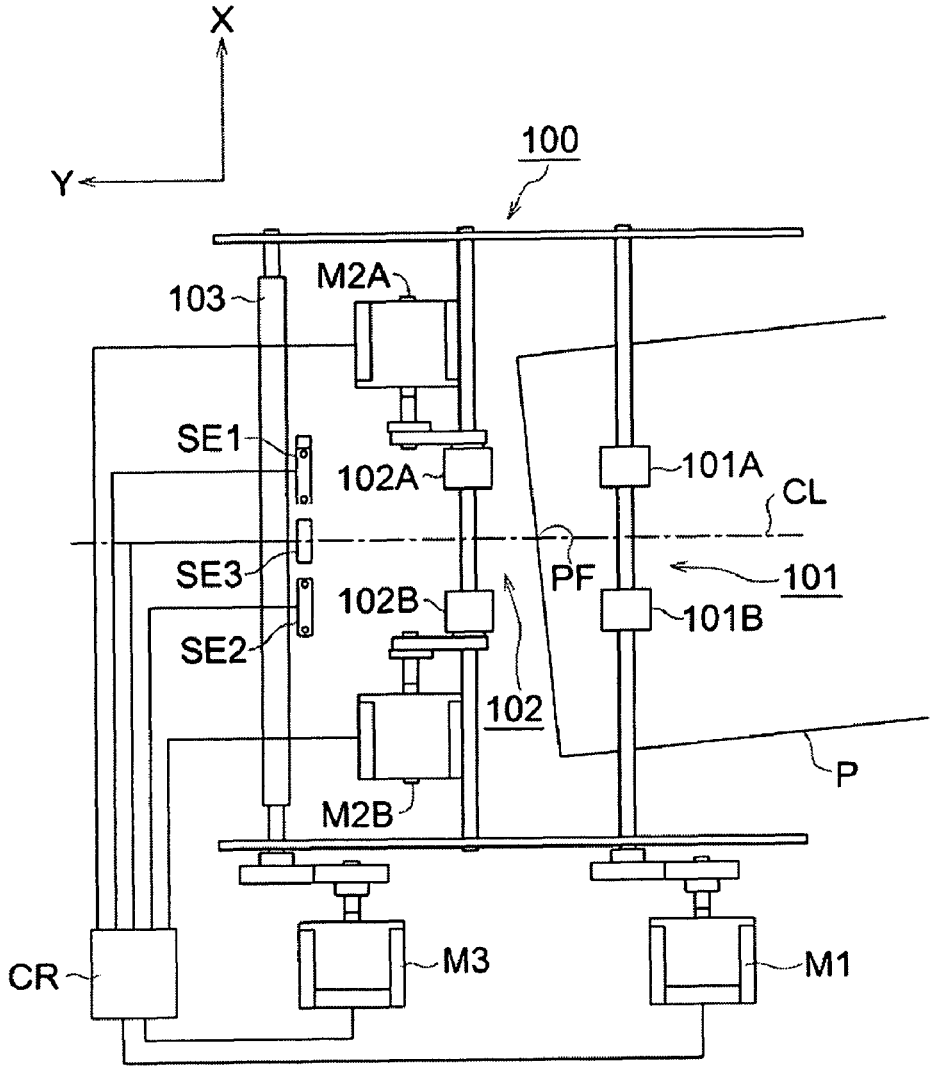
FIG. 3 is a plan view of the conveyance section shown in FIG. 2.

FIG. 2 and FIG. 3 show the conveyance section view that supplies sheets to the transfer position TR (See FIG. 1), and FIG. 2 is a lateral section view while FIG. 3 is a plan view.

In the conveyance section 100, the conveyance roller 101, the loop forming roller 102 and the registration roller 103 are arranged sequentially from upstream of the sheet P conveyance direction and the sheet P is thereby conveyed.

In addition, the conveyance section 100 has a guide plate that guides the conveyed sheet and the guide plates 104A and 104B, the guide plates 105A and 105B, and the guide plates 106A and 106B are sequentially arranged from the upstream side.

The lower guide plate 106A between the loop forming roller 102 and the registration roller 103 is bent in the lower direction and a space for forming a loop on the sheet is formed.

The conveyance roller 101 has conveyance roller pairs 101A and 101B that sandwich the center line CL that is in the direction perpendicular to the conveyance direction of the sheet.

The loop forming roller 102 has the loop forming roller pairs 102A and 102B that sandwich the center line CL that is in the direction perpendicular to the conveyance direction. The loop forming roller pair 102A is driven by the stepping motor M2A and the loop forming roller pair 102B is driven by the stepping motor M2B.

In addition, the conveyance roller 101 is driven by the stepping motor M1. The registration roller 103 is driven by the stepping motor M3.

The stepping motor M1, M2A, M2B and M3 are controlled by the control section CR.

The sensors SE1 and SE2 are the skew detection sensors that detect the leading edge of the sheet P. The skew detection sensors SE1 and SE2 are serially arranged so as to sandwich the center line CL and the sheet detection sensor SE3 is arranged on the center line.

The control section CR performs conveyance timing and sheet skew correction in the conveyance section 100.

[Control of Sheet Conveyance Timing]

Figure 4:
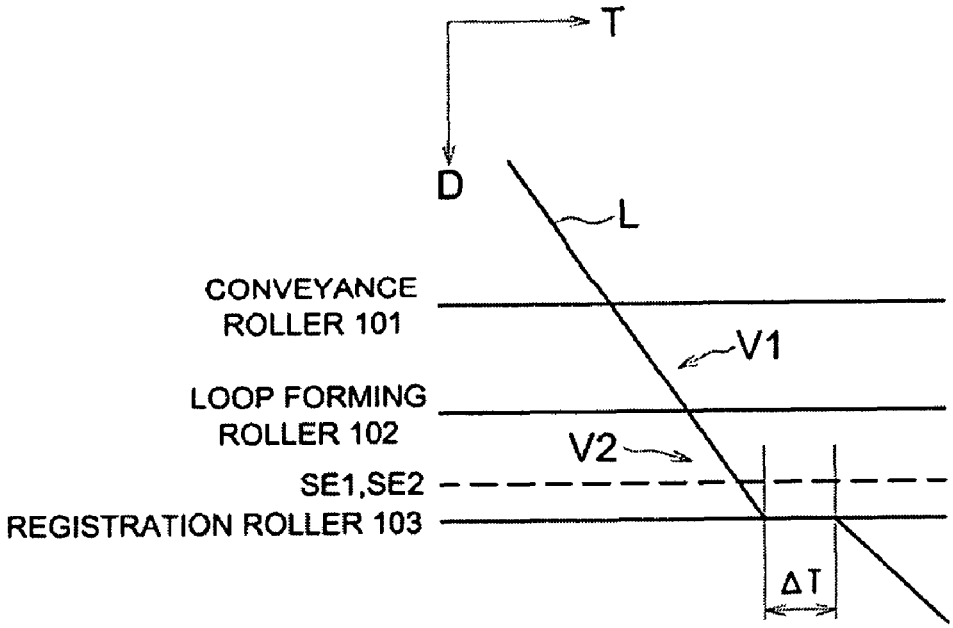
FIG. 4 is a timing chart for describing conveyance timing control.

As shown in FIG. 4, the control section CR controls conveyance timing.

In FIG. 4, the line L shows the conveyance path for the leading edge of the sheet. That is to say, in FIG. 4, the T axis shows the passage of time T and the D axis shows the running distance D of the sheet P.

The sheet P is conveyed by the conveyance roller 101 and runs to the loop roller 102 and then conveyed by the loop forming roller 102 and runs to the register roller 103 and then conveyed again in the direction of the transfer position TR after stop time ΔT at the position of the registration roller 103.

The conveyance speed of the conveyance roller 101 and the loop forming roller 102 is v1, while the conveyance speed of the registration roller 103 is v2. These conveyance speeds are set such that v1>v2.

The stop time ΔT is the time for forming the loop on sheet P at the upstream direction of the registration roller 103 and also the time for synchronizing with image formation and determines the relationship with the exposure start time.

That is to say, at the transfer position TR (See FIG. 1), the start timing for conveyance of the registration roller 103 is controlled such that the relationship between leading end of the color toner image on the intermediate transfer member 7 and the leading end of the sheet P always have a fixed relationship.

By providing the stop time ΔT, a loop is formed on the upstream side of the registration roller 103 and because of this loop, a force causing the sheet to return to its original state is generated and skew of the sheet P is corrected.

[Skew Correction]

At the position of the dotted line in FIG. 4, the leading edge of the sheet P is detected by the skew detection sensors SE1 and SE2 respectively. The control section CR controls the stepping motor M2A based on the detection signal from the skew detection sensor SE1 and controls the stepping motor M2B based on the detection signal of the sensor SE2.

As shown in FIG. 3, the detection signals of the skew detection sensors SE1 and SE2 that detected conveyed sheet P in a skew state in which the leading edge PF is offset from the direction X that is orthogonal to the conveyance direction Y, are output with timing difference.

The loop forming roller 102 include two loop forming roller pairs 102A and 102B and the control section CR independently controls the stepping motors M2A and M2B at different speeds and thus the loop forming roller pairs 102A and 102B are driven at different speeds, respectively.

More specifically, in skew correction, the correction section CR controls the rotation speed of the stepping motors M2A and M2B respectively in accordance with the time difference of the leading edge detection of the sensors SE1 and SE2.

That is to say, the rotation speed of the motor that drives the loop forming roller pair at the side where detection timing is earlier is delayed, while the rotation speed of the motor that drives the loop forming roller pair at the side where detection timing is delayed, is quickened and thereby skew of the sheet is corrected.

A sheet detection sensor SE3 for detecting the leading edge of the sheet is disposed on the upstream side of the registration roller 103.

The loop forming roller pairs 102A and 102B are stopped after a prescribed time after the sheet detection sensor SE3 detects the leading edge of the sheet.

The stopping timing of the loop forming roller pairs 102A and 102B is set such that a loop is formed on the sheet P, upstream with respect to the registration roller 103.

The skew of the sheet P is further corrected by loop formation on the upstream side of the registration roller 103.

The registration roller 103 starts up after the loop forming roller pair 102A and 102B stop and the sheet P is conveyed toward the transfer position TR.

Next, another example of the skew correction will be described.

In this skew correction, independent control of the loop forming roller pair 102A and 102B which form the loop forming roller 102 is carried out by controlling the stop timing of the loop forming roller pair 102A and 102B.

Figure 5:
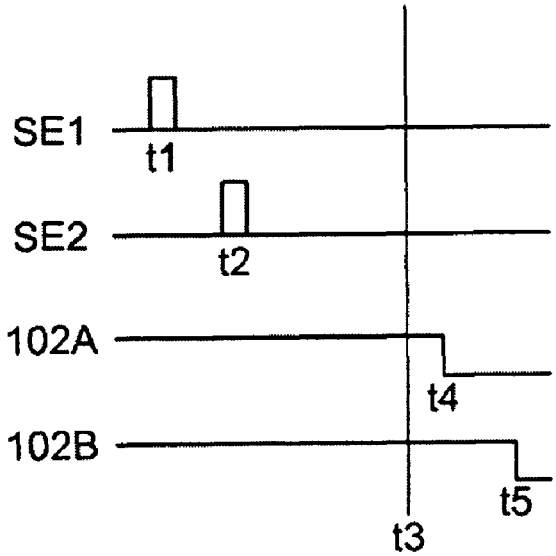
FIG. 5 is a timing chart for describing skew correction.

Control in the example of skew correction is described using FIG. 5.

In this example of skew correction, the control section CR controls the loop forming roller pair 102A and 102B such that they are driven at the same conveyance speed.

The leading edge of the sheet P is detected by the skew detection sensor SE1 at time t1 and the leading edge of the sheet P is detected by the skew detection sensor SE2 at time t2.

The control section CR continues driving of the loop forming roller pair 102A and 102B after leading edge detection and the loop forming roller pair 102A is stopped at time t4 and the loop forming roller pair 102B is stopped at time t5.

Because (t4-t1)=(t5-t2), the running distance of the sheet P from the detection positions of the skew detection sensor SE1 and SE2 becomes the same between both ends in the direction which orthogonally crosses the conveyance direction and the skew is corrected.

It is to be noted that the time from leading edge detection by the skew detection sensors SE1 and SE2 to when they stop, may be set to a suitable value obtained by experiments.

The leading edge of the sheet P reaches the registration roller 103 at time t3 which is before the stop time t4 of the loop forming roller pair 102A and during time t3-t4, a loop is formed on the sheet P on the upstream side of the registration roller 103.

The leading edge of the sheet P abuts the nip of the registration roller 103 and stops and by the loop being formed, parallelism with respect to the direction X of the leading edge is further increased, and skew correction can be done with high accuracy.

While the skew correction described above is being performed, the sheet P is conveyed by the conveyance roller 101 upstream of the loop forming roller 102.

This conveyance will be described with reference to FIG. 3. The conveyance distance by the loop forming roller pair 102A and 102B disposed at both sides so as to sandwich the center line CL in the direction that orthogonally crosses the conveyance direction are not equal to each other due to independent control of the loop forming roller pair 102A and 102B. That is, in skew correction using conveyance speed control, due to the difference in conveyance speed, and in skew correction using stop timing control, due to the difference in stop timing, the conveyance distance by the loop forming roller pair 102A and the conveyance distance by the loop forming roller pair 102B are different.

Meanwhile, the conveyance roller pair 101A and 101B constituting the conveyance roller 101 conveys the sheet P by the same conveyance distance as each other.

Due to this difference in the conveyance distance of the loop forming roller 102 and the conveyance distance of the conveyance roller 101, tension bias in the direction perpendicular to the sheet conveyance direction is generated on the sheet P.

Due to this tension bias, skew correction sometimes does not function sufficiently.

In addition, problems occur such as generation of creases on the sheet and the like.

The present embodiment solves these problems by sliding the conveyance roller 101 in the rotation axis direction.

That is, when the tension bias is generated, the force generated by this tension operates and the conveyance roller pair 101A and 101B constituting the conveyance roller 101 slides in the axial direction, or in other words, in the X direction. Due to this axial direction slide, the tension bias is relaxed and the correction function can be sufficiently carried out and the skew is corrected.

Figure 6:
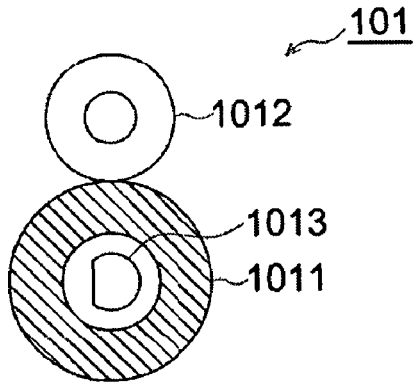
FIGS. 6(*a*) and 6(*b*) are views describing conveyance rollers.
Figure 6:
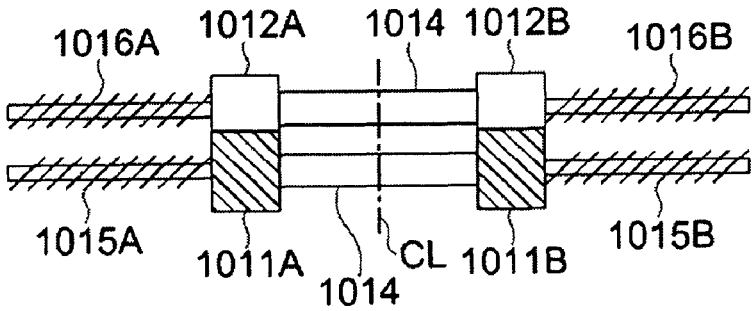
Figure 7:
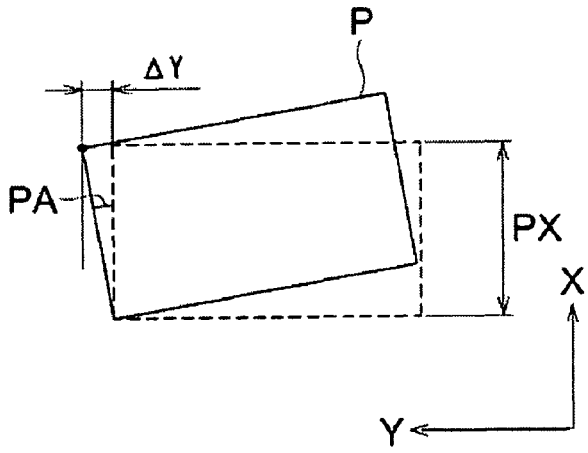
FIG. 7 is a view for describing a sheet skew.

As shown in FIG. 6(*a*), the conveyance roller 101 is constituted of a drive roller 1011 and a slave roller 1012, but the drive roller 1011 is fitted to the shaft 1013 that was "D" cut and is slid in the axial direction, and the drive force of the shaft 1013 is transmitted to the drive roller 1011.

In this manner, the conveyance roller arranged upstream of the loop forming roller 102 is provided with a mechanism which slides in the axial direction, and the conveyance roller includes not only the conveyance roller 101, but also the upstream side conveyance roller.

That is, the conveyance roller that nips the sheet at the same time with the loop forming roller 102 has a mechanism which slides in the axial direction, and in the example of FIG. 1, this mechanism is provided in the conveyance rollers 23 and 24 in the conveyance section between the sheet storage section 20 and the conveyance section 100, and in the conveyance section 26*a* near the conveyance section 100 of the re-feeding section 26.

In FIG. 1, the conveyance rollers 23 and 24 in the conveyance section between the sheet storage section 20 and the conveyance section 100, and the conveyance roller 26*a* in the re-feeding section 26 are provided with a mechanism that slides in the axial direction.

It is to be noted that a returning member that slides the conveyance roller 101 in the rotation direction and then returns it to the reference position is preferably provided.

FIG. 6(*b*) is an example in which an elastic member formed from a spring is the return member, and as shown in FIG. 6(*b*), the conveyance roller pair 101A and 101B are connected by the connecting member 1014.

The drive roller 1011A and the slave roller 1012A that form the conveyance roller pair 101A are urged in the direction of the center line CL by the compression coil springs 1015A and 1016A, and the drive roller 1011B and the slave roller 1012B that form the conveyance roller pair 101B are urged in the direction of the center line CL by the compression coil springs 1015B and 1016B and the urging force is balanced at the center position.

Thus, after conveyance of the paper, the conveyance pair 101A and 101B are symmetrical to the center line CL due to the coil springs 1015A, 1016A, 1015B, and 1016B, and they return to the reference position where the respective urging forces are equal.

In this embodiment, tension bias generated on the sheet in the case where skew is corrected is relaxed by sliding the conveyance rollers disposed upstream of the loop forming roller in the axial direction using the loop forming roller that are arranged in parallel in the direction which orthogonally crosses the conveyance direction and are independently controlled.

Thus, due to the tension bias, problems such as insufficient skew correction function or generation of creases when excess force acts on the paper are solved and images are formed on the sheet with high positional accuracy.

In addition, it becomes possible to favorably perform skew correction for paper of various thicknesses or on processed paper such as coated paper, and thus image formation with high positional accuracy becomes possible on various types of paper.

Furthermore, skew correction can also be sufficiently performed in high-speed conveyance and thus an image formation apparatus including high speed and high quality images performance can be realized.

What is claimed is:

1. An image forming apparatus including an image forming section which forms an image on a sheet and a conveyance section which conveys the sheet to the image forming section, the conveyance section comprising:

(a) a registration roller, (b) a plurality of pairs of loop forming rollers which cause the sheet to form a loop, provided upstream of the registration roller in a sheet conveyance direction and arranged in a direction perpendicular to the sheet conveyance direction, two pairs of loop forming rollers of the plurality pairs being arranged on opposite sides with respect to a center line in the direction perpendicular to the sheet conveyance direction;

(c) a skew detection sensor which detects a skew of the sheet, and (d) a conveyance roller provided upstream of the loop forming roller, which is configured to be slidable in the direction perpendicular to the sheet conveyance direction;

and (e) a control section which controls independently each of the plurality pairs of loop forming rollers based on the detected result of the skew detection sensor, wherein when a tension bias force is generated on the sheet by a tension bias which is caused by a difference between a conveyance distance of the sheet conveyed by one pair of loop forming rollers and that conveyed by another pair of loop forming rollers, the conveyance roller is slid by the tension bias force in the direction perpendicular to the sheet conveyance direction.

2. The image forming apparatus of claim 1, wherein the control section drives each of the plurality of pairs of loop forming rollers at a conveyance speed different from each other based on the detected result detected by the skew detection sensor.

3. The image forming apparatus of claim 1, wherein the control section controls a conveyance speed of each of the plurality of pairs of loop rollers based on the detected result detected by the skew detection sensor.

4. The image forming apparatus of claim 1, wherein the conveyance roller comprises a restoring member which restores the conveyance roller to a reference position thereof after being slid.

5. The image forming apparatus of claim 1, wherein the skew detection sensor comprises a plurality of skew detection sensors which are disposed in the direction perpendicular to the sheet conveyance direction.

6. The image forming apparatus of claim 1, wherein the skew detection sensor comprises a sensor array in which a plurality of detection elements are arranged in the direction perpendicular to the sheet conveyance direction.

* * * * *